US007951098B2

(12) United States Patent
Wu et al.

(10) Patent No.: US 7,951,098 B2
(45) Date of Patent: May 31, 2011

(54) AMPLITUDE CHANGE-OVER DEVICE FOR A BODY VIBRATION MACHINE

(75) Inventors: Mu-Chuan Wu, Tainan Hsien (TW); Vince Wu, Tainan Hsien (TW); Ts Lang Wang, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 914 days.

(21) Appl. No.: 11/905,206

(22) Filed: Sep. 28, 2007

(65) Prior Publication Data

US 2009/0086569 A1 Apr. 2, 2009

(51) Int. Cl.
*A61H 23/02* (2006.01)

(52) U.S. Cl. ..... 601/49; 601/61; 601/65; 601/70

(58) Field of Classification Search ..... 601/46, 601/49, 56–61, 65, 67, 68, 69, 70, 72, 73, 601/74; 310/81; 366/128

See application file for complete search history.

(56) References Cited

U.S. PATENT DOCUMENTS

| | | | | |
|---|---|---|---|---|
| 2,945,970 | A * | 7/1960 | Nordegren | 310/81 |
| 3,919,575 | A * | 11/1975 | Weber et al. | 310/81 |
| 4,172,986 | A * | 10/1979 | Iwaide | 310/81 |
| 2007/0239088 | A1 * | 10/2007 | Wu | 601/49 |
| 2009/0264801 | A1 * | 10/2009 | Van Der Meer | 601/70 |

* cited by examiner

*Primary Examiner* — Danton DeMille
(74) *Attorney, Agent, or Firm* — Bacon & Thomas, PLLC

(57) ABSTRACT

An amplitude change-over device for a body vibration machine includes two eccentric units respectively fixed on the opposite ends of a rotating shaft driven by a motor. Each eccentric unit contains an eccentric driving plate secured with the rotating shaft for rotating together and an eccentric driven plate movably fitted on the rotating shaft at one side of the driving plate. Either one of the driving plate or the driven plate has a surface bored with a slide groove with the rotating shaft acting as a pivot, and another one has a surface provided with a projecting stud inserted in the slide groove. The motor is a right-handed and left-handed one. When the motor is chosen to rotate clockwise or counterclockwise, the included angle of the driving plate and the driven plate is changeable and hence amplitude power is adjustable by using a single motor.

9 Claims, 11 Drawing Sheets

AMPLITUDE CHANGE-OVER DEVICE FOR A BODY VIBRATION MACHINE

BACKGROUND OF THE INVENTION

1. Field of the Invention

This invention relates to an amplitude change-over device for a body vibration machine, particularly to one able to change and adjust the strength of amplitude and the value of gravitational acceleration for tallying with a user's requirement in training muscular strength by adjusting a single motor with same frequency to rotate clockwise or counterclockwise.

2. Description of the Prior Art

In reality, our daily activities are affected anytime and anyplace by gravity, and the influence of gravity is a basis for developing our muscular strength. Conventional weight training acted on a human body (gravity Fz) is to employ extra weight and load to be imposed upon the human body. Substantially, human body can naturally enhance its muscular strength to cope with increase of weight and load imposed thereon. Dumbbells and other weight training apparatuses are extra loads for training muscular strength. During taking exercises, a man's body will carry out self-adjustment and correction in accordance with increase of extra loads and hence a man's muscular power can be strengthened and his body will become stronger than ever before.

Compared with conventional weight training, body vibration training does not need extra loads, so it will not be affected by gravity but by acceleration. When an object or a human body changes its velocity in a very short time, assimilation of acceleration will be expanded. According to a formula: Fz (gravity)=m (individual body weight)×a (gravitational acceleration, m/sec.$^2$), when acceleration (a) increases, a body working strength will also be actuated to increase. In comparison with conventional weight training (added with loads), vibration training without extra loads can attain an effect of exercise training faster than the conventional weight training; therefore, body vibration machines used for training a man's muscular power have been widely used.

A conventional body vibration machine 10, as shown in FIGS. 1~4, includes a standing table 11, an upright post 15, a handrail 16 and a control faceplate 17 combined together.

The standing table 11 is positioned over a base plate 12, and a plurality of buffering and elastic support cylinders 13 are assembled between the base plate 12 and the standing table 11 to connect them together so that when a user stands on the standing table 11, the standing table 11 can produce a buffer effect. The standing table 11 has an intermediate portion of its underside secured with the outer casing of a motor 14, as shown in FIG. 3, and the motor 14 has a rotating shaft 140 with two opposite ends respectively fixed thereon with an eccentric plate 141. Thus, after the motor 14 is started to operate, the two eccentric plates 141 fixed on the opposite ends of the rotating shaft 140 will make the motor 14 produce eccentric vibration, and the standing table 11 secured with the outer casing of the motor 14 will be actuated to vibrate synchronously.

The upright post 15 extending upward is fixedly connected with a front end of the base plate 12.

The handrail 16 and the control faceplate 17 are fixed at the upper end of the upright post 15. When standing on the standing table 11, a user can hold the handrail 16 for supporting and controlling the working conditions of the body vibration machine 10 by means of the control faceplate 17.

In using of the conventional body vibration machine 10, as shown in FIG. 1, after a user stands on the standing table 11 and holds on the handrail 16, the motor 14 is started to operate and, by its eccentric vibration force, driving the standing table 11 to vibrate continuously, and simultaneously the user's body will be actuated to produce continuous vibration, thus achieving effect of exercise training.

However, the conventional body vibration machine 10 can produce only one single amplitude. Under the circumstances, if users of different body conditions need to use different-strength amplitudes, it is necessary to change the extent of the amplitude and for this purpose, the eccentric plate 141 at the opposite ends of the rotating shaft 140 of the motor 14 have to be replaced, thus increasing trouble in disassembling and replacing of the eccentric plates 141 and resulting in inconvenience in use. In another case, if the eccentric plates 141 are not to be replaced, then two motors with different amplitudes have to be used for change of amplitude, thus increasing producing cost and weight of the body vibration machine.

SUMMARY OF THE INVENTION

The objective of this invention is to offer an amplitude change-over device for a body vibration machine, able to change the extent of amplitude by using a single motor so that a user can choose proper amplitude for use according to exercise strength, principle of gradual progress and exercise adaptability.

The feature of this invention is two eccentric units respectively fixed on the opposite ends of a rotating shaft driven to rotate by a motor. Each eccentric unit consists of an eccentric driving plate secured with the rotating shaft for rotating together and an eccentric driven plate movably fitted on the rotating shaft abutting one side of the driving plate. Either one of the driving plate or the driven plate has its surface bored with an arc-shaped slide groove with the rotating shaft acting as a pivot, and another one has a corresponding end of its surface fixed with a projecting stud inserted in the slide groove. The motor of this invention is a right-handed and left-handed one. By so designing, the motor can be chosen to rotate clockwise or counterclockwise to change an included angle between the driving plate and the driven plate for changing centrifugal force, and hence strength of amplitude can be optionally adjusted for use by changing the rotating directions of a single motor.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
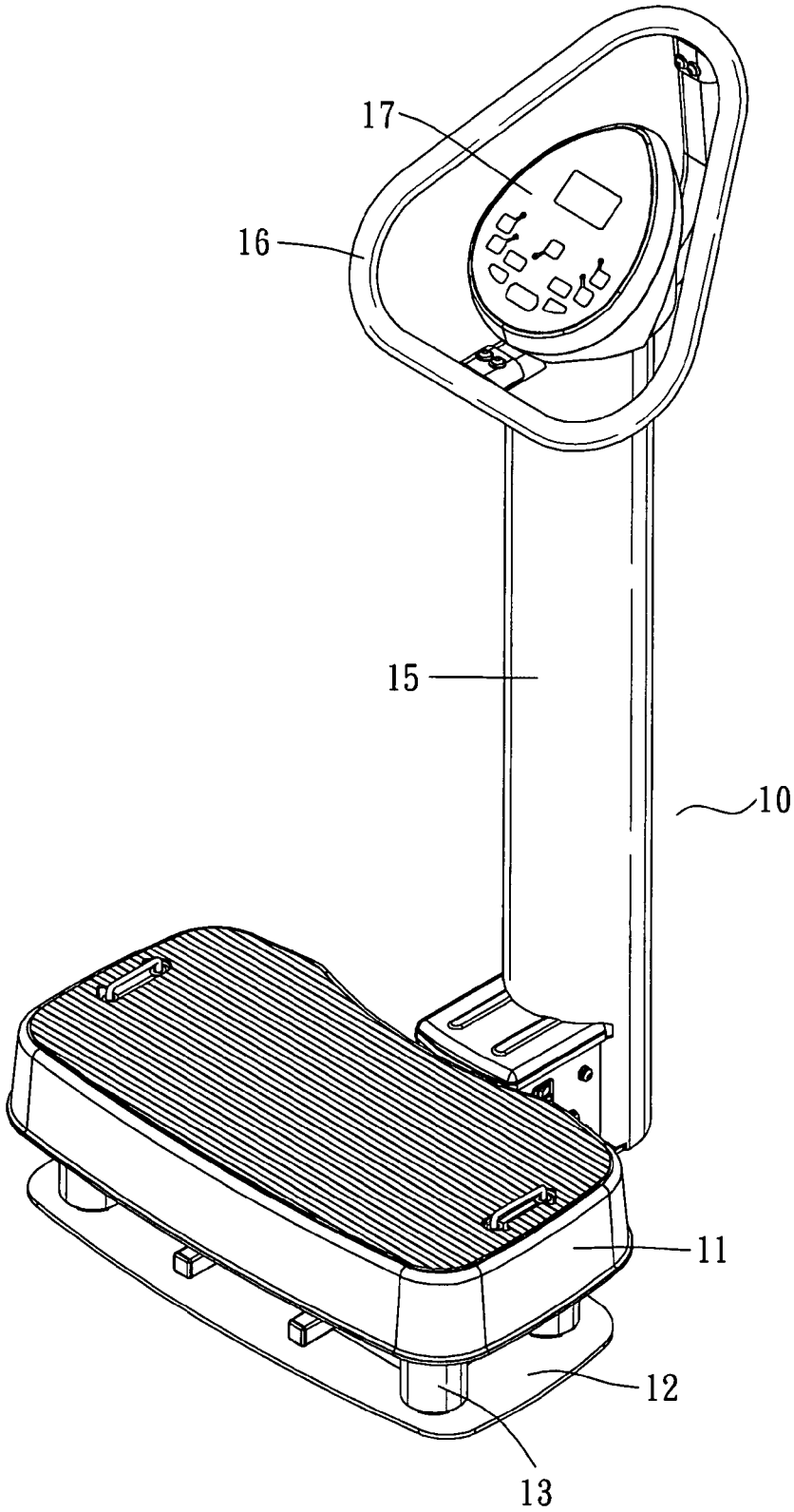
FIG. 1 (PRIOR ART)
FIG. 1 is a perspective view of a conventional body vibration machine.
Figure 2:
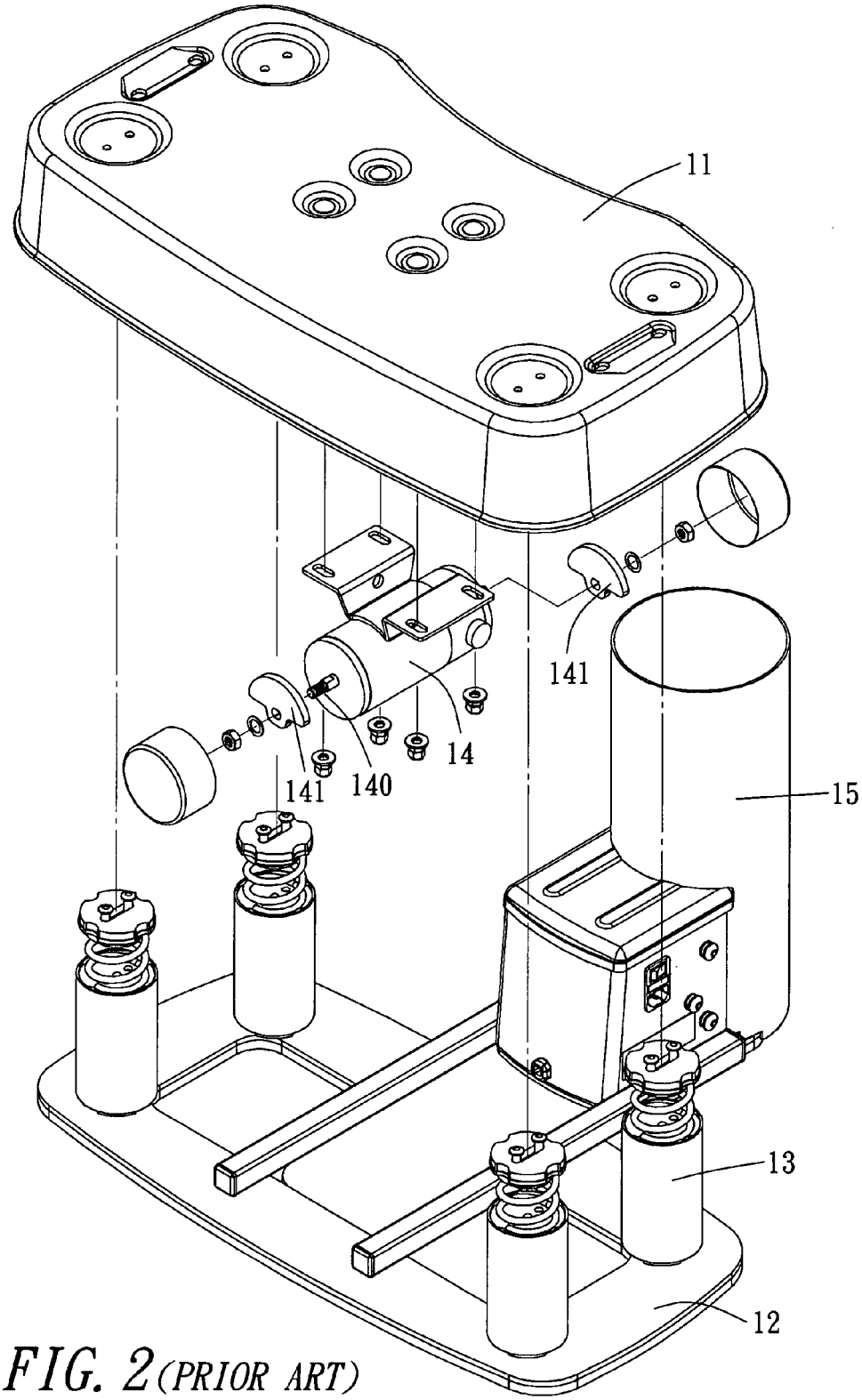
FIG. 2 (PRIOR ART)
FIG. 2 is an exploded perspective view of a standing table of the conventional body vibration machine.
Figure 3:
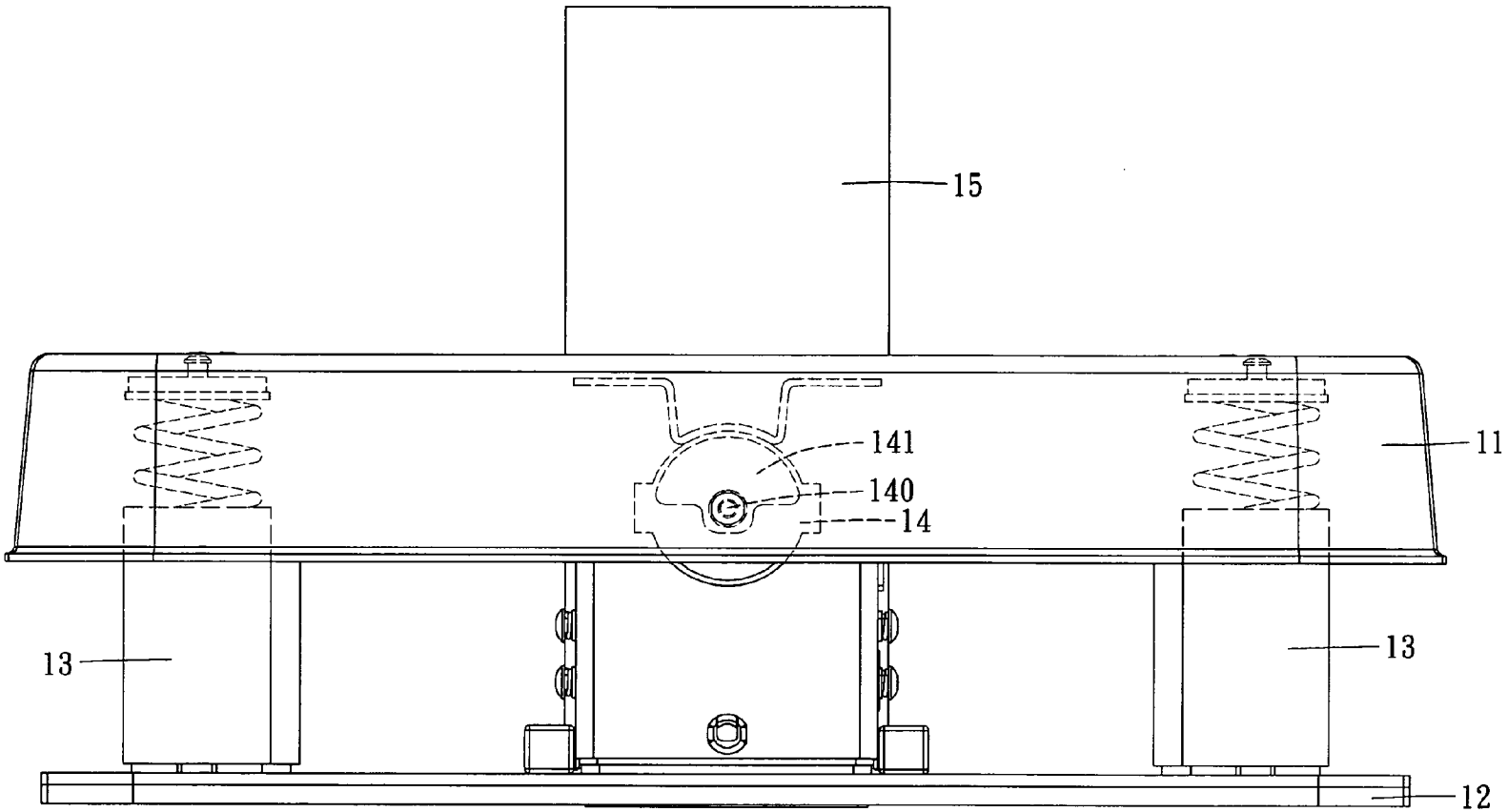
FIG. 3 (PRIOR ART)
FIG. 3 is a cross-sectional view of the standing table of the conventional body vibration machine.
Figure 4:
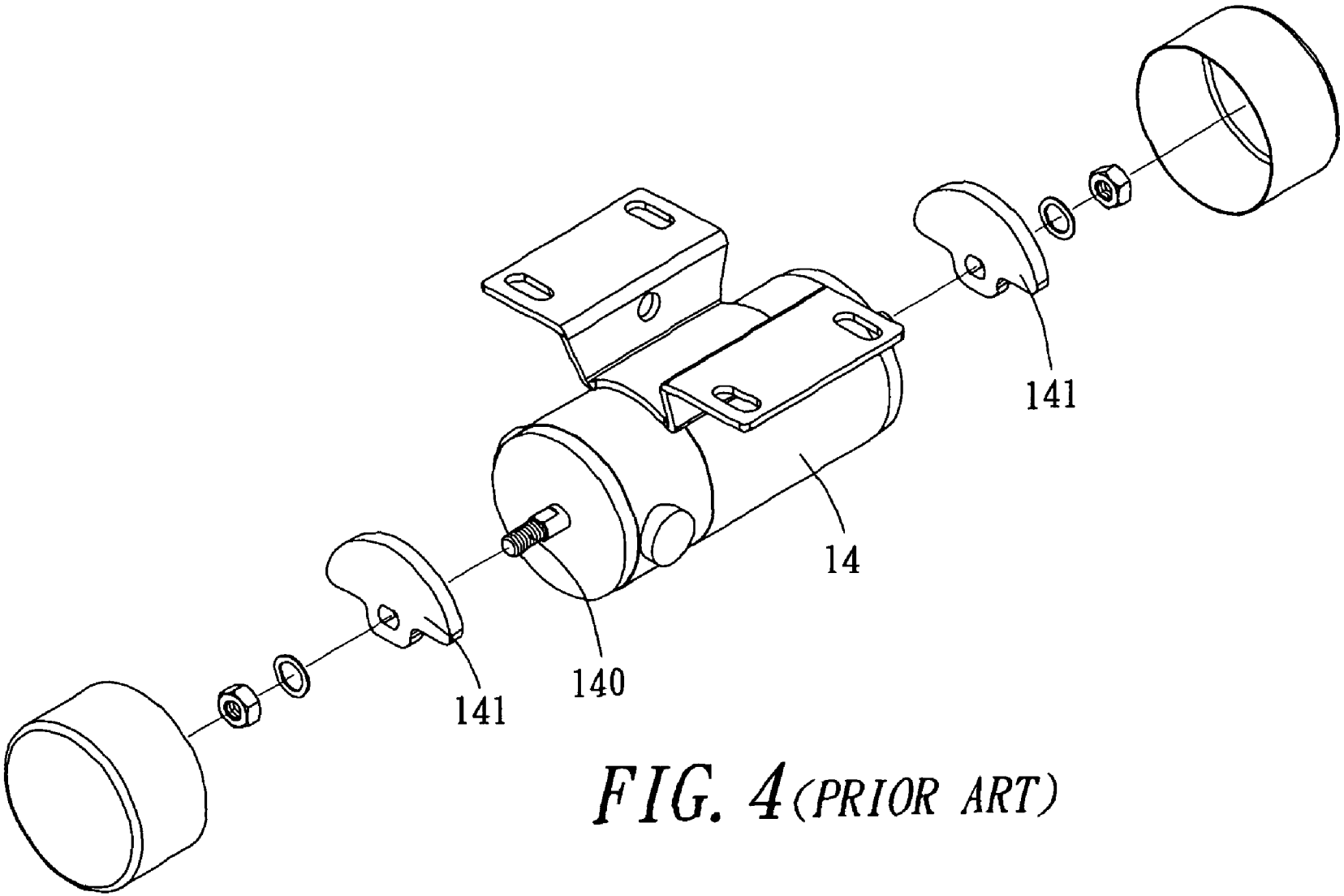
FIG. 4 (PRIOR ART)
FIG. 4 is an exploded perspective view of a motor and two eccentric plates of the conventional body vibration machine.
Figure 5:
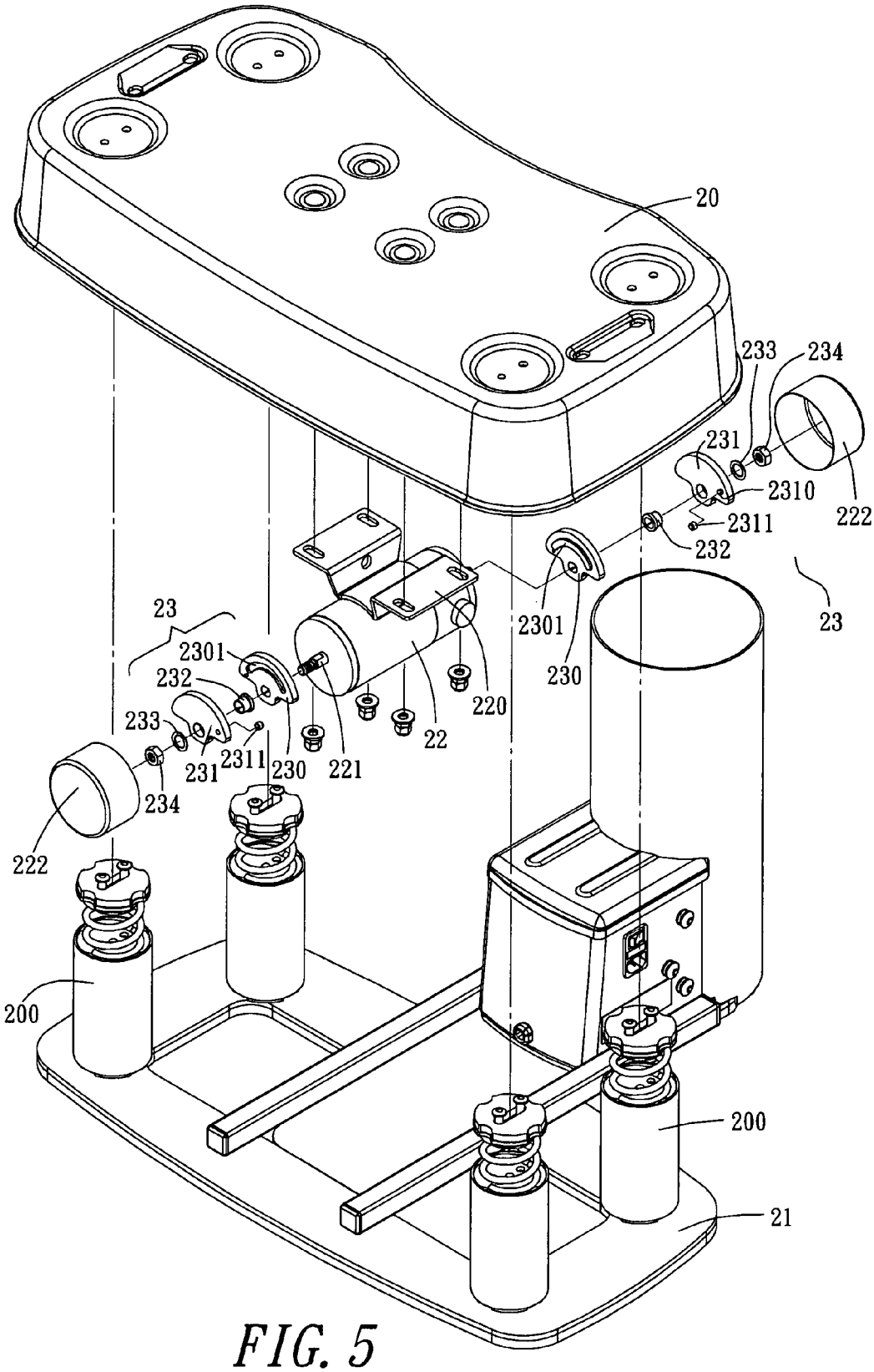
FIG. 5 is an exploded perspective view of a first preferred embodiment of a standing table of a body vibration machine in the present invention.
Figure 6:
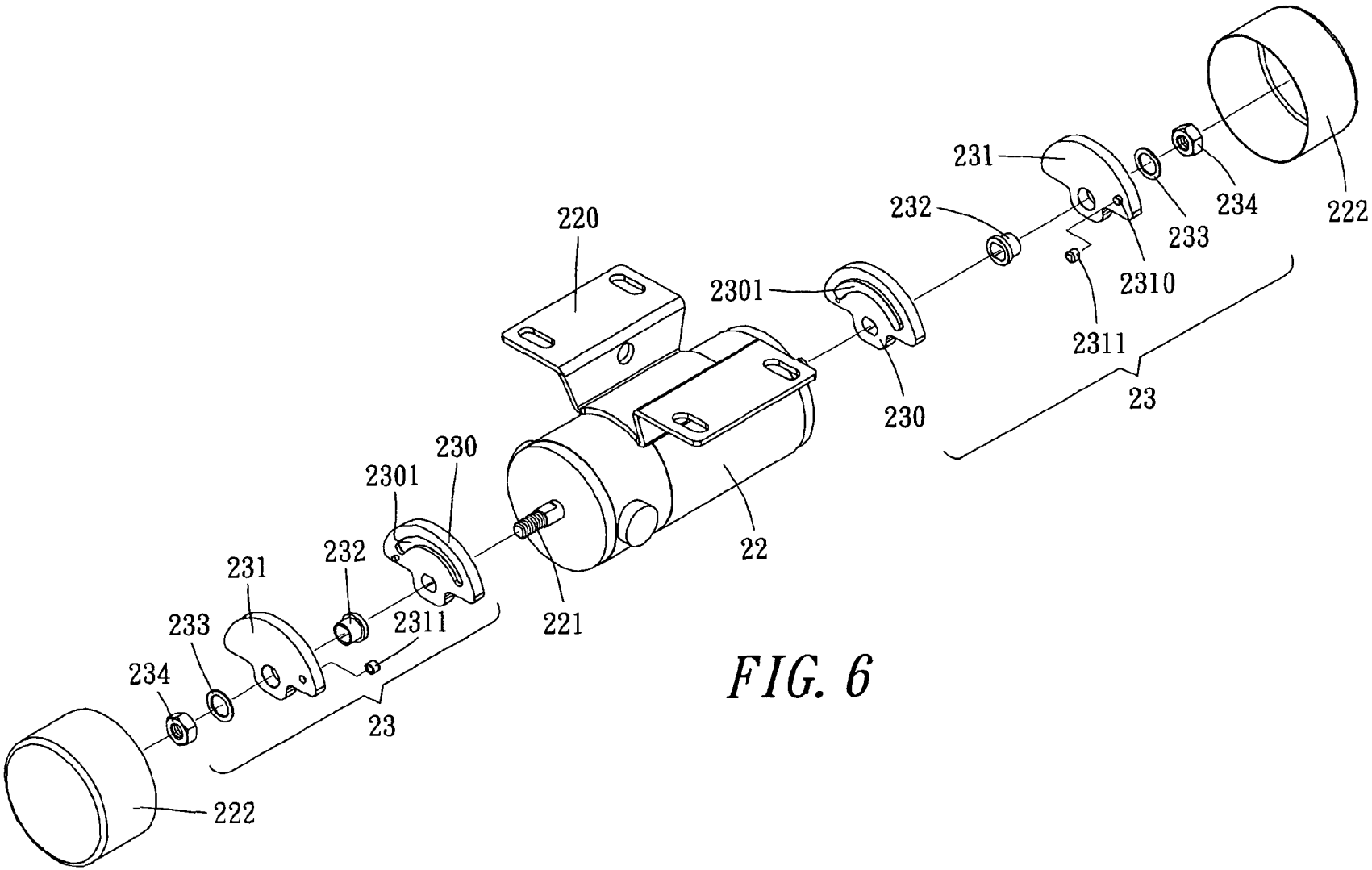
FIG. 6 is an exploded perspective view of the first preferred embodiment of a motor and two eccentric units of the body vibration machine in the present invention.
Figure 7:
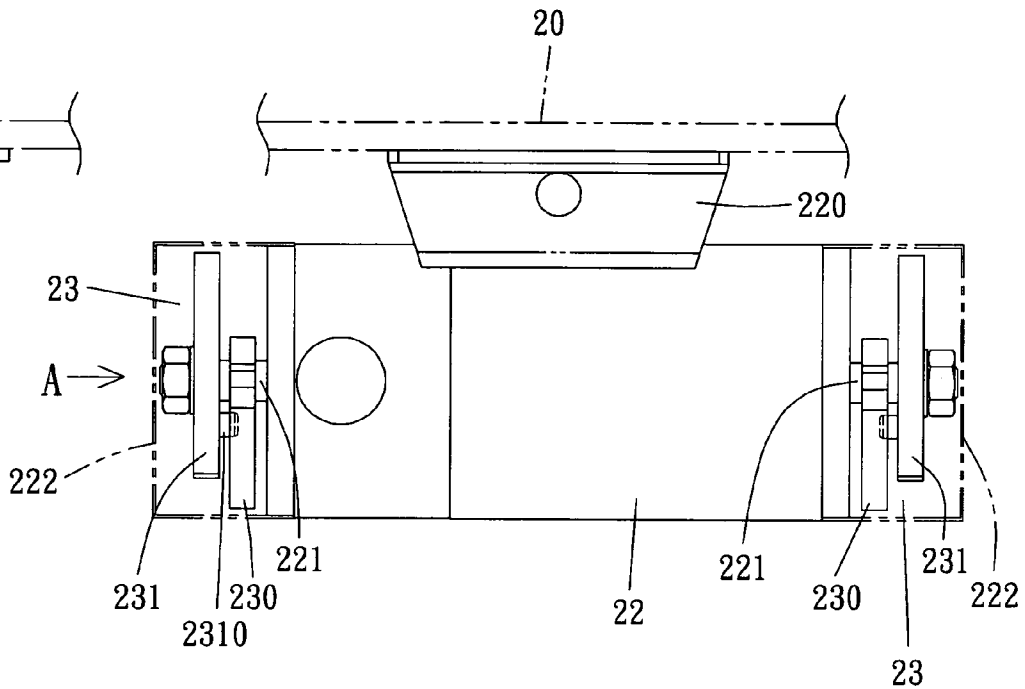
FIG. 7 is a side cross-sectional view of the first preferred embodiment of the eccentric units during the motor rotating clockwise in the present invention.

A first preferred embodiment of an amplitude change-over device for a body vibration machine in the present invention, as shown in FIGS. 5, 6 and 7, includes a standing table 20, a base plate 21, a motor 22, an upright post, a handrail, a control faceplate and two eccentric units 23 combined together.

The upright post, the handrail and he control faceplate are the same as those in the conventional body vibration machine, so their description are omitted here. Besides, those components can be saved in a body vibration machine, as a user can stand on the standing table, with a hand holding something stationary.

The standing table 20, as shown in FIG. 5, is positioned over the base plate 21, and a plurality of buffer and elastic support cylinders 200 are assembled between the base plate 21 and the standing table 20 to connect them together.

Figure 8:
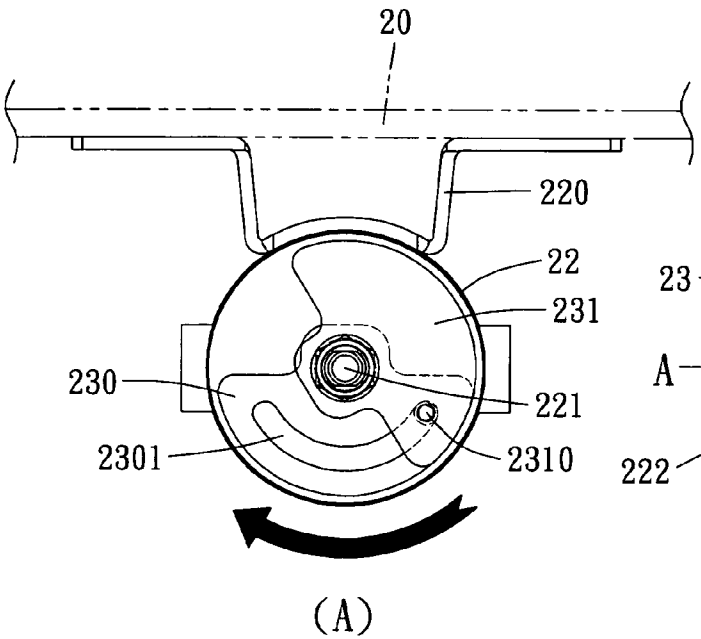
FIG. 8 is a front cross-sectional view of the first preferred embodiment of the eccentric units during the motor rotating clockwise in the present invention.

The motor 22 has its outer casing secured thereon with a fixing frame 220 to be firmly combined with an intermediate portion of the underside of the standing table 20, as shown in FIG. 8. The motor 22 can be a right-handed and left-handed one provided with a rotating shaft 221 having the opposite ends respectively and correspondingly fixed with the eccentric unit 23. Thus, when the motor 22 is started, the two opposite eccentric units 23 on the rotating shaft 221 driven by the motor 22 will be rotated to produce a centrifugal force, and the standing table 20 fixed with the outer casing of the motor 22 will be actuated to vibrate.

The improvements made in the invention are described below.

The two eccentric units 23 fixed on the opposite ends of the rotating shaft 221 driven by the motor 22 are respectively composed of an eccentric driving plate 230 and an eccentric driven plate 231.

The eccentric driving plate 230 is of a sector shape, having its eccentric portion secured with the rotating shaft 221 of the motor 22 for rotating together with the rotating shaft 221. The driving plate 230 is bored with an arc-shaped slide groove 2301 with the rotating shaft 221 acting as a pivot.

The eccentric driven plate 231 is also of a sector shaped, having its eccentric portion movably fitted on the rotating shaft 221 adjacent to one side of the driving plate 230, with a bush 232 fitted on the rotating shaft 221 to separate the driving plate 230 from the driven plate 231 so as to prevent them from producing surface contact friction. The driven plate 231 is provided with a projecting stud 2310 at one side facing the driving plate 230. The projecting stud 2310 has its outside fitted thereon with a sound-proof sleeve 2311 and then they are together inserted in the arc-shaped slide groove 2301 of the driving plate 230. After fitted on the rotating shaft 221, the driven plate 231 is fixed with the rotating shaft 221 by means of a rubber gasket 233 and a locking nut 234 for preventing the driven plate 231 from slipping off the rotating shaft 221, and then two motor covers 222 are respectively fixed with the outer casing of the motor 22 for covering up both the driving plate 230 and the driven plate 231.

After foresaid components under the standing table 20 are combined together, the body vibration machine is finished assembling, as shown in FIGS. 7 and 8. After a user stands on the standing table 20, the motor 22 is started to operate and drive the standing table 20, and the user's body to produce continuous vibration, thus attaining effect of exercise training. Two conditions of operating and using the body vibration machine are described as follows.

1. When the rotating shaft 221 of the motor 22 is controlled by the control faceplate to rotate clockwise, as shown in FIGS. 7 and 8, both the motor 22 and the driving plates 230 will be driven to rotate clockwise simultaneously. When the motor 22 and the driving plates 230 are rotated to reach a limit location where one end of the arc-shaped slide groove 2301 of the driving plate 230 touches the projecting stud 2310 of the driven plate 231, the driven plate 231 will be hooked and actuated by the driving plate 230 to rotate together with the driving plate 230 synchronously. At this time, the driving plate 230 and the driven plate 231 are staggered in position with a large included angle. According to a formula: F (centrifugal force)=m (mass)×$w^2$ (angular velocity)×r (radius), the included angle and the centrifugal force are of reverse ratio. Therefore, the amplitude of the motor 22 and the standing table 20 becomes low.

Figure 9:
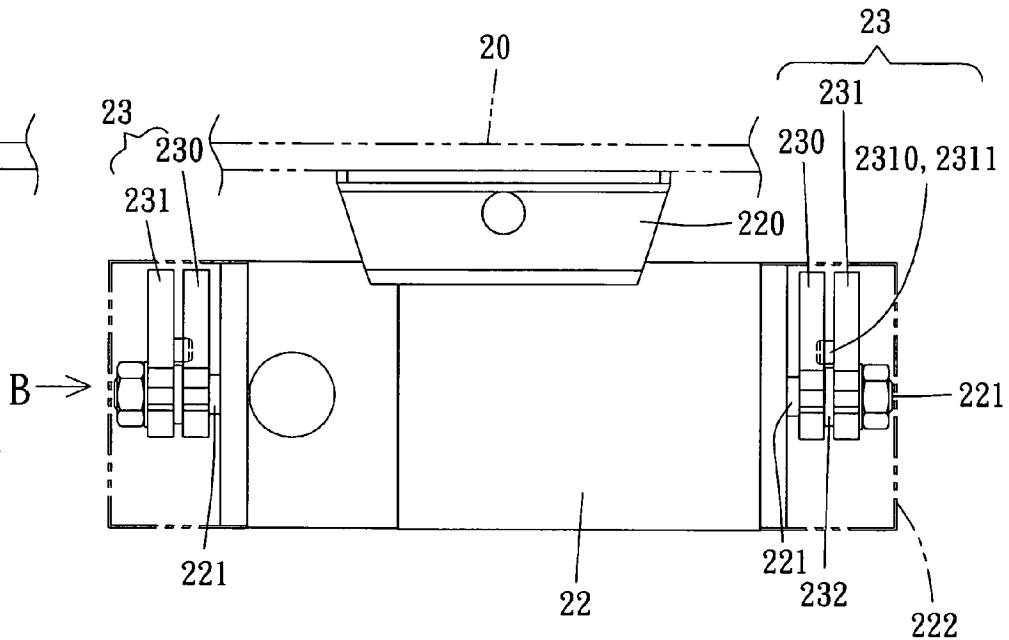
FIG. 9 is a side cross-sectional view of the first preferred embodiment of the eccentric units during the motor rotating counterclockwise in the present invention.
Figure 10:
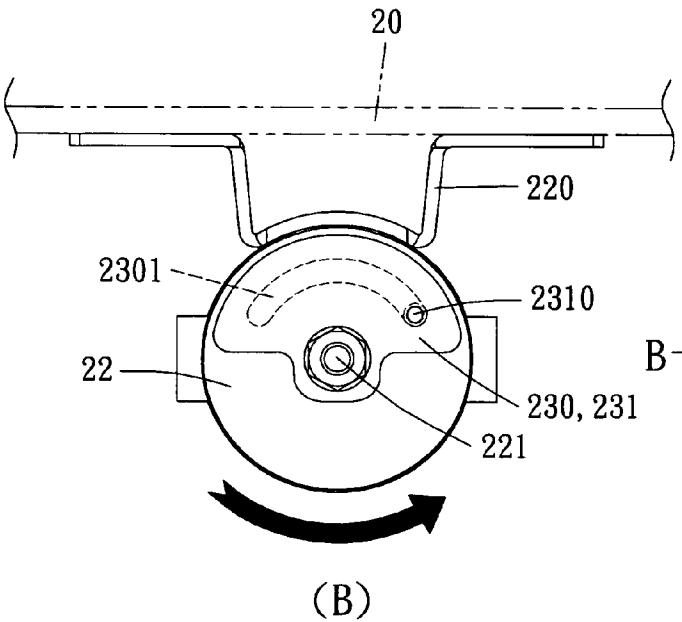
FIG. 10 is a front cross-sectional view of the first preferred embodiment of the eccentric units during the motor rotating counterclockwise in the present invention.

2. When the control faceplate controls the rotating shaft 221 of the motor 22 to rotate counterclockwise, as shown in FIGS. 9 and 10, the motor 22 and the driving plates 230 will synchronously rotate counterclockwise. When the driving plates 230 are rotated to reach a limit location where the other end of the arc-shaped slide groove 2301 of the driving plate 23 touches the projecting stud 2310 of the driven plate 231, the driven plate 231 will be hooked and actuated by the driving plate 230 to rotate together with the driving plate 230 synchronously. At this time, the driving plate 230 and the driven plate 231 are overlapped in position and their included angle becomes small, and according to the formula: F (centrifugal force)=m (mass)×$w^2$ (angular velocity)×(radius), the included angle and the centrifugal force are of reverse ratio; therefore, the centrifugal force is increased, and the amplitude of the motor 22 and the standing table 20 becomes high.

As can be understood from the above description, the amplitude of the standing table 20 and the motor 22 can be changed only by controlling the motor 22 to rotate clockwise or counterclockwise. Thus, by employing a single motor, the body vibration machine of this invention can produce two different-strength amplitudes to be optionally chosen for use in accordance with different body conditions of the users.

Figure 11:
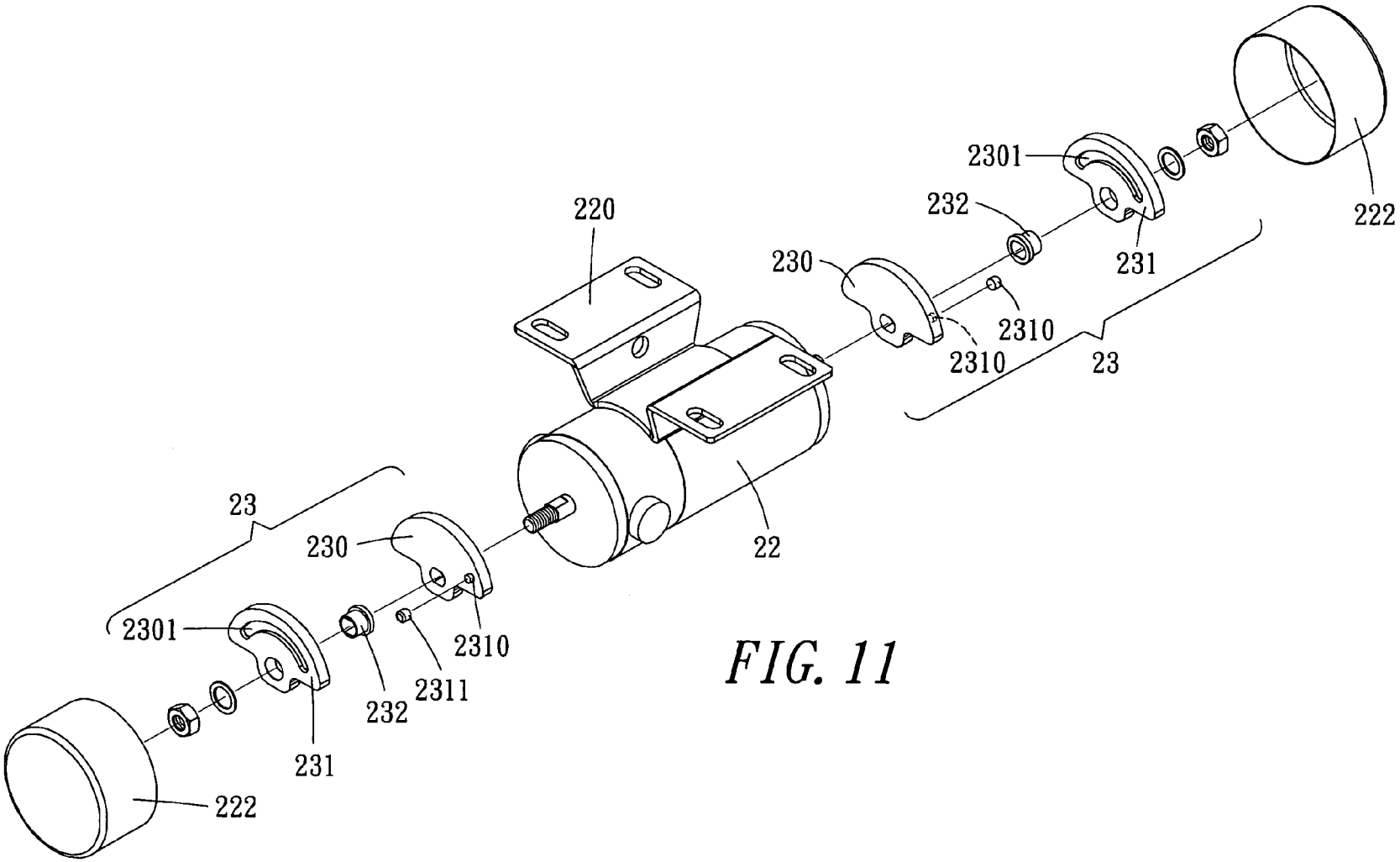
FIG. 11 is an exploded perspective view of a second preferred embodiment of the motor and the eccentric units of a body vibration machine in the present invention.

A second preferred embodiment of an amplitude change-over device for a body vibration machine in the present invention, as shown in FIG. 11, has almost the same structure as that described in the first preferred embodiment, except that the driven plate 231 instead of the driving plate 230 is bored with the arc-shaped slide groove 2301, while the driving plate 230 instead of the driven plate 231 is provided with the projecting stud 2310, thus equally enabling the driving plate 230 and the driven plate 231 to be mutually hooked and actuated to rotate together.

Figure 12:
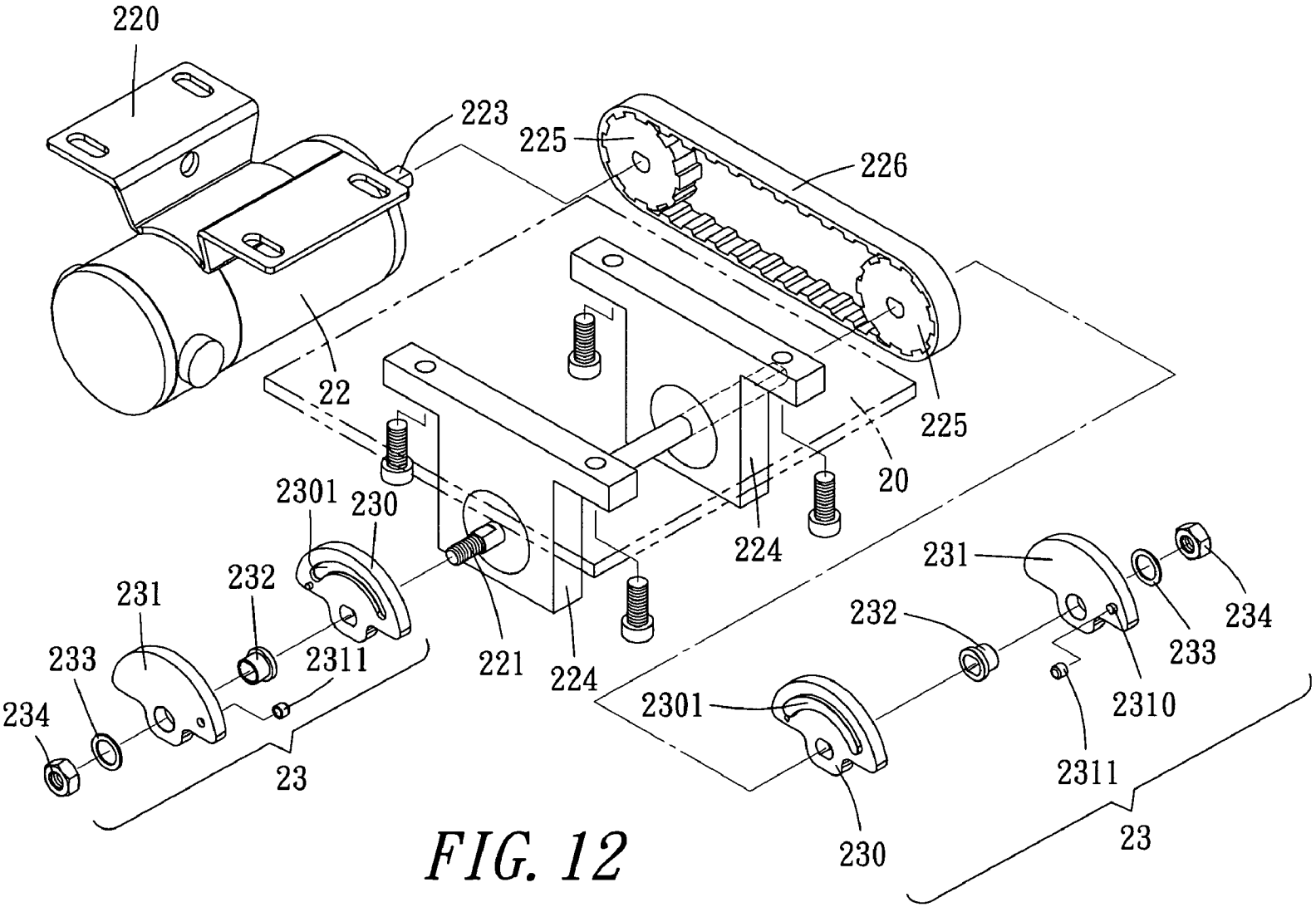
FIG. 12 is an exploded perspective view of a third preferred embodiment of the rotating shaft to be driven by a motor in the present invention.
Figure 13:
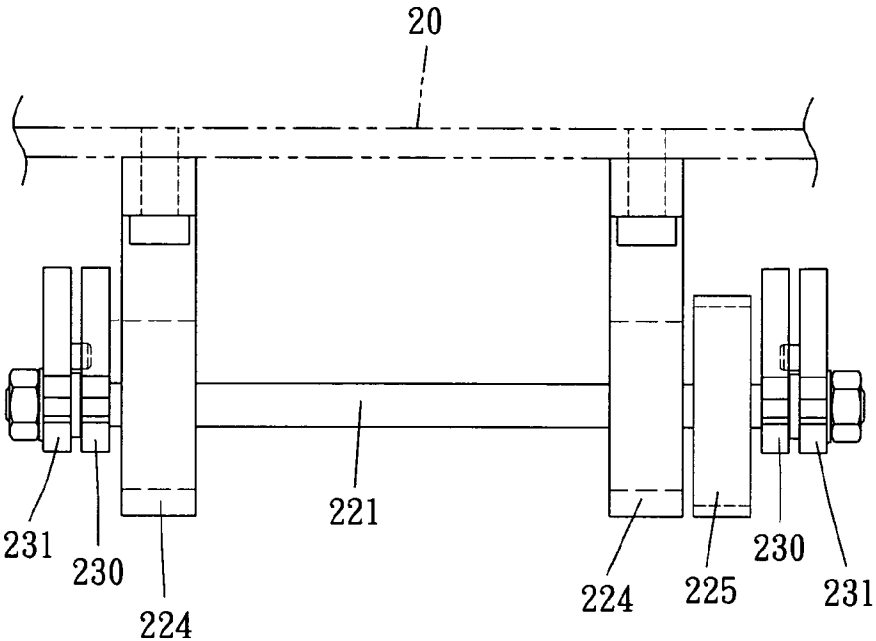
FIG. 13 is a front view of the third preferred embodiment of the rotating shaft driven by the motor in the present invention.
Figure 14:
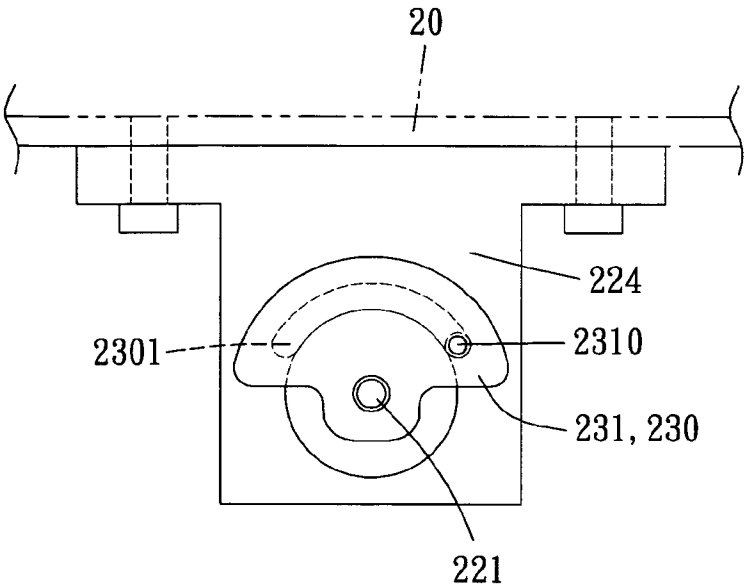
FIG. 14 is a side cross-sectional view of the third preferred embodiment of the rotating shaft driven by the motor in the present invention.

A third preferred embodiment of an amplitude change-over device for a body vibration machine in the present invention, as shown in FIGS. 12, 13 and 14, is to have the rotating shaft 221, which has two eccentric units 23 fixed thereon, pivotally inserted and assembled on two support bases 224 located near one side of the motor 22. The driving shaft 223 of the motor 22 and the rotating shaft 221 have their corresponding ends respectively fixed thereon with a gear 225, and a driving belt 226 is connected with the two gears 225 for driving the rotating shaft 221 to rotate together with the driving shaft 223 of the motor synchronously.

While the preferred embodiments of the invention have been described above, it will be recognized and understood that various modifications may be made therein and the appended claims are intended to cover all such modifications that may fall within the spirit and scope of the invention.

We claim:

1. An amplitude change-over device for a body vibration machine comprising:

a standing table positioned over a base plate, said base plate and said standing table fixed therebetween with a plurality of buffer support cylinders, a user standing on a topside of said standing table;

a motor positioned under said standing table and having its outer casing secured with an underside of said standing table, a rotating shaft driven by said motor having its opposite ends respectively fixed thereon with an eccentric unit, said rotating shaft rotated eccentrically to actuate both said outer casing of said motor and standing table to produce continuous vibration when said motor is started; and, characterized by said eccentric units fixed on opposite ends of said rotating shaft driven by said motor, each said eccentric unit composed of an eccentric driving plate secured with said rotating shaft for rotating together and an eccentric driven plate disposed near one side of said driving plate, said driven plate having its eccentric portion movably fitted on said rotating shaft, either one of said driving plate or said driven plate having one surface bored with a slide groove with said rotating shaft acting as a pivot, and another one having a corresponding end of its surface fixed with a projecting stud inserted in said slide groove, said motor being a right-handed and left-handed one changeable in rotating directions; and size of included angle between said driving plate and said driven plate able to be adjusted for changing amplitude of said motor when said motor is chosen to rotate clockwise or counterclockwise, thus amplitude of vibration able to be changed by employing a single motor.

2. The amplitude change-over device for a body vibration machine as claimed in claim 1, wherein said rotating shaft between said driving plate and said driven plate is fitted thereon with a bush for separating said driving plate from said driven plate.

3. The amplitude change-over device for a body vibration machine as claimed in claim 1, wherein said projecting stud has its outside fitted with a sound-proof sleeve and then they are together inserted in said slide groove.

4. The amplitude change-over device for a body vibration machine as claimed in claim 1, wherein said slide groove is bored in a surface of said driving plate, and said projecting stud is fixed on a surface of said driven plate.

5. The amplitude change-over device for a body vibration machine as claimed in claim 1, wherein said slide groove is bored in a surface of said driven plate, and said projecting stud is disposed on an surface of said driving plate.

6. The amplitude change-over device for a body vibration machine as claimed in claim 1 or 4 or 5, wherein said slide groove is arc-shaped.

7. The amplitude change-over device for a body vibration machine as claimed in claim 1, wherein said rotating shaft is directly driven by said motor.

8. The amplitude change-over device for a body vibration machine as claimed in claim 1, wherein said rotating shaft is pivotally inserted and assembled on two support bases positioned near one side of said motor and said rotating shaft is driven by a driving shaft of said motor to rotate together with said driving shaft synchronously by means of a transmitting unit.

9. The amplitude change-over device for a body vibration machine as claim in claim 8, wherein said transmitting unit is composed of two gears respectively fixed on said driving shaft of said motor and on said rotating shaft, and a belt connecting said two gears for driving them to rotate synchronously.

* * * * *